US008136699B2

(12) United States Patent
Bianchini

(10) Patent No.: US 8,136,699 B2
(45) Date of Patent: Mar. 20, 2012

(54) BAR SOAP RECYCLER

(76) Inventor: Giovanni Bianchini, Los Angeles, CA (US)

( * ) Notice: Subject to any disclaimer, the term of this patent is extended or adjusted under 35 U.S.C. 154(b) by 583 days.

(21) Appl. No.: 12/368,495

(22) Filed: Feb. 10, 2009

(65) Prior Publication Data

US 2009/0206110 A1 Aug. 20, 2009

Related U.S. Application Data

(60) Provisional application No. 61/028,976, filed on Feb. 15, 2008.

(51) Int. Cl.

| | |
|---|---|
| ***B67D 1/07*** | (2006.01) |
| ***B67D 1/16*** | (2006.01) |
| ***B65D 88/54*** | (2006.01) |
| ***B01L 3/02*** | (2006.01) |

(52) U.S. Cl. ..... 222/108; 222/192; 222/321.9; 422/521

(58) Field of Classification Search ..... 222/192, 222/321.7, 321.8, 321.9, 181.1, 181.3, 108, 222/181.2, 385; 422/521, 522
See application file for complete search history.

(56) References Cited

U.S. PATENT DOCUMENTS 3,920,164 A * 11/1975 Lindsoe ..... 222/385

* cited by examiner

*Primary Examiner* — Kevin P Shaver
*Assistant Examiner* — Stephanie E Williams
(74) *Attorney, Agent, or Firm* — James A. Italia; Italia IP

(57) ABSTRACT

A device for recycling bar soap by passing the drippings, pieces and slivers of soap in the soap dish into a reservoir to form a reusable liquid. The soap dish is mounted on the top of a reservoir, and is provided with an opening communicating with the reservoir. Water or liquid soap can be placed in the reservoir to combine with the soap drippings, slivers and pieces. A dispensing valve or pump communicates with the liquid in the reservoir to provide a way for the user to access the recycled soap mixture. The opening in the soap dish can be closed by a plug to allow the reservoir alternatively to be used to dispense other liquids such as hand lotion.

11 Claims, 4 Drawing Sheets

BAR SOAP RECYCLER

CROSS-REFERENCE TO RELATED APPLICATION

This application claims the benefit of the filing date under 35 USC 119(e) of the filing date of U.S. Provisional Application Ser. No. 61/028,976, filed Feb. 15, 2008, the contents of which are incorporated herein by reference.

BACKGROUND OF THE INVENTION

This application relates a device for recycling drippings, bits and slivers of a bar of soap that is placed for use in a soap dish by mixing them with water or liquid soap in a reservoir and then dispensing the resulting soap solution by means of a valve or pump.

SUMMARY

Bars of soap, such as those commonly used to wash one's hands, to bath and to shower, usually are kept in a soap dish. They are removed from the soap dish for use, and when they are returned to the soap dish after use, the wet bar of soap deposits soap drippings in the soap dish. Typically, the soap dish periodically is cleaned and the drippings are discarded. Also typically discarded are bits and small pieces of soap that may come off of the bar, as well as the small slivers of bars that remain at the end of the bar's life. This is wasteful. The present invention allows soap drippings, small pieces and slivers to pass through an opening in the soap dish and be collected in a reservoir, to be recycled into a useful liquid soap.

The bar soap recycler of the invention comprises side walls and a bottom panel attached together to define a reservoir for containing a quantity of liquid. The reservoir has an open top, at which a soap dish is installed for receiving a bar of soap. The soap dish has an opening which communicates with the reservoir for permitting drippings, bits and slivers of soap and liquids to be introduced into the reservoir. Dispensing means are provided for dispensing liquid from the reservoir, whereby the drippings, bits and slivers of soap and liquids that have been passed into the reservoir are combined to be recycled and dispensed for use.

In one embodiment of the invention the bar soap recycler comprises a front wall, a back wall, a pair of opposed side walls and a bottom panel attached together to define a generally rectangular reservoir for containing a quantity of liquid. The reservoir has an open top, at which a soap dish installed for receiving a bar of soap. An opening in the soap dish communicates with the reservoir for permitting drippings, bits and slivers of soap and liquids to be introduced into the reservoir. A valve is installed in the bottom panel, in communication with said reservoir, for dispensing liquid from the reservoir, and a mounting bracket is attached to the reservoir to permit it to be mounted on a vertical surface. Thus, drippings, bits and slivers of soap and liquids combined in said reservoir can be dispensed for use.

In another embodiment, the invention comprises an upstanding curvilinear side wall and a bottom panel attached together to define a reservoir for containing a quantity of liquid. The reservoir has an open top, and a soap dish is installed at the open top for receiving a bar of soap. An opening is located in the soap dish in communication with the reservoir for permitting drippings, bits and slivers of soap and liquids to be introduced into the reservoir. A liquid dispensing pump is mounted on the reservoir extending upwardly therefrom and in communication with the reservoir, allowing the device to be operated when placed on a horizontal surface.

BRIEF DESCRIPTION OF THE DRAWINGS

The drawings, when considered in conjunction with the following description, are presented for the purpose of facilitating an understanding of the invention sought to be protected.

DESCRIPTION

Figure 1:
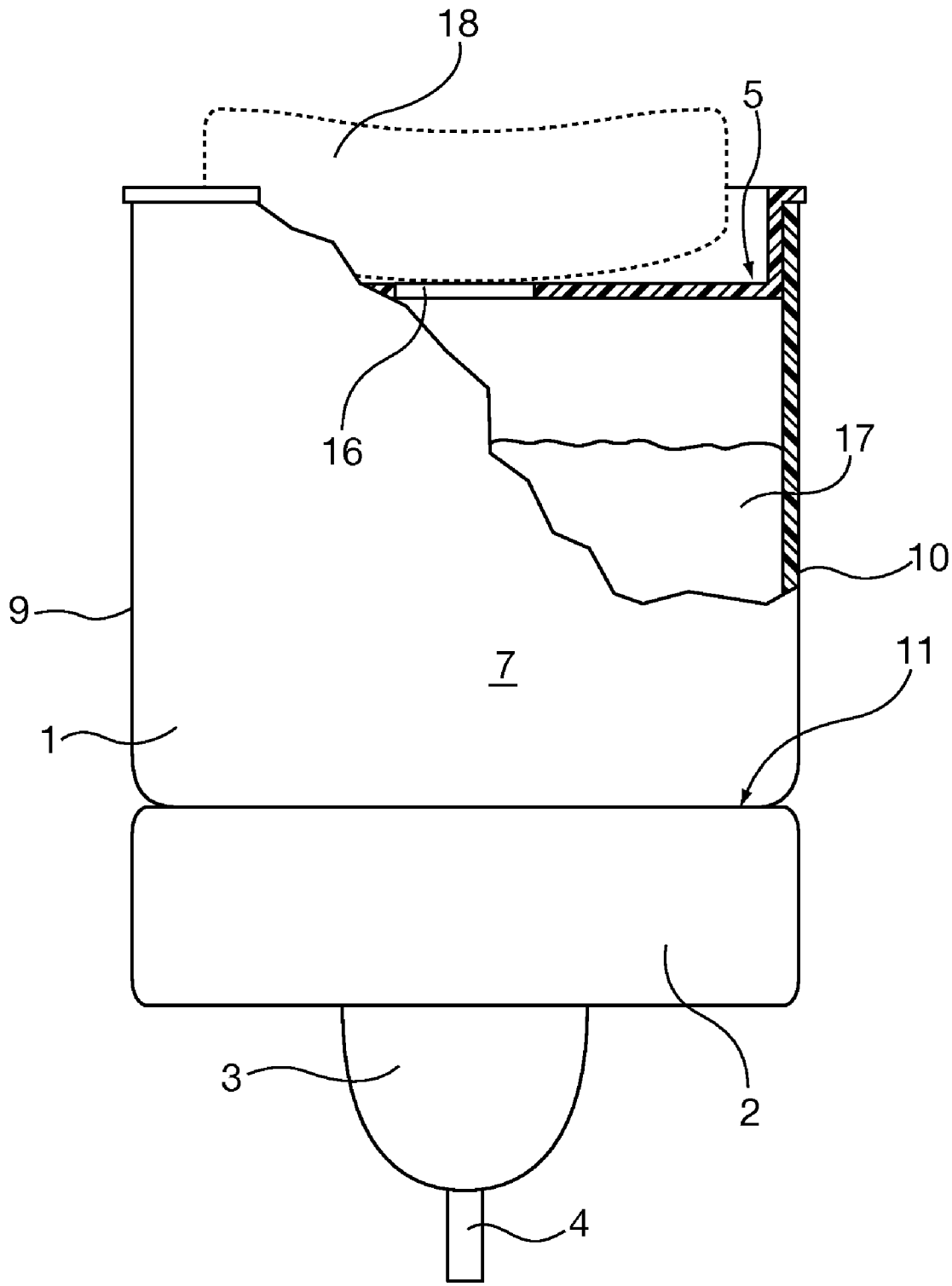
FIG. 1 is a front view of a first embodiment of the bar soap recycler of the invention, partially in section.
Figure 2:
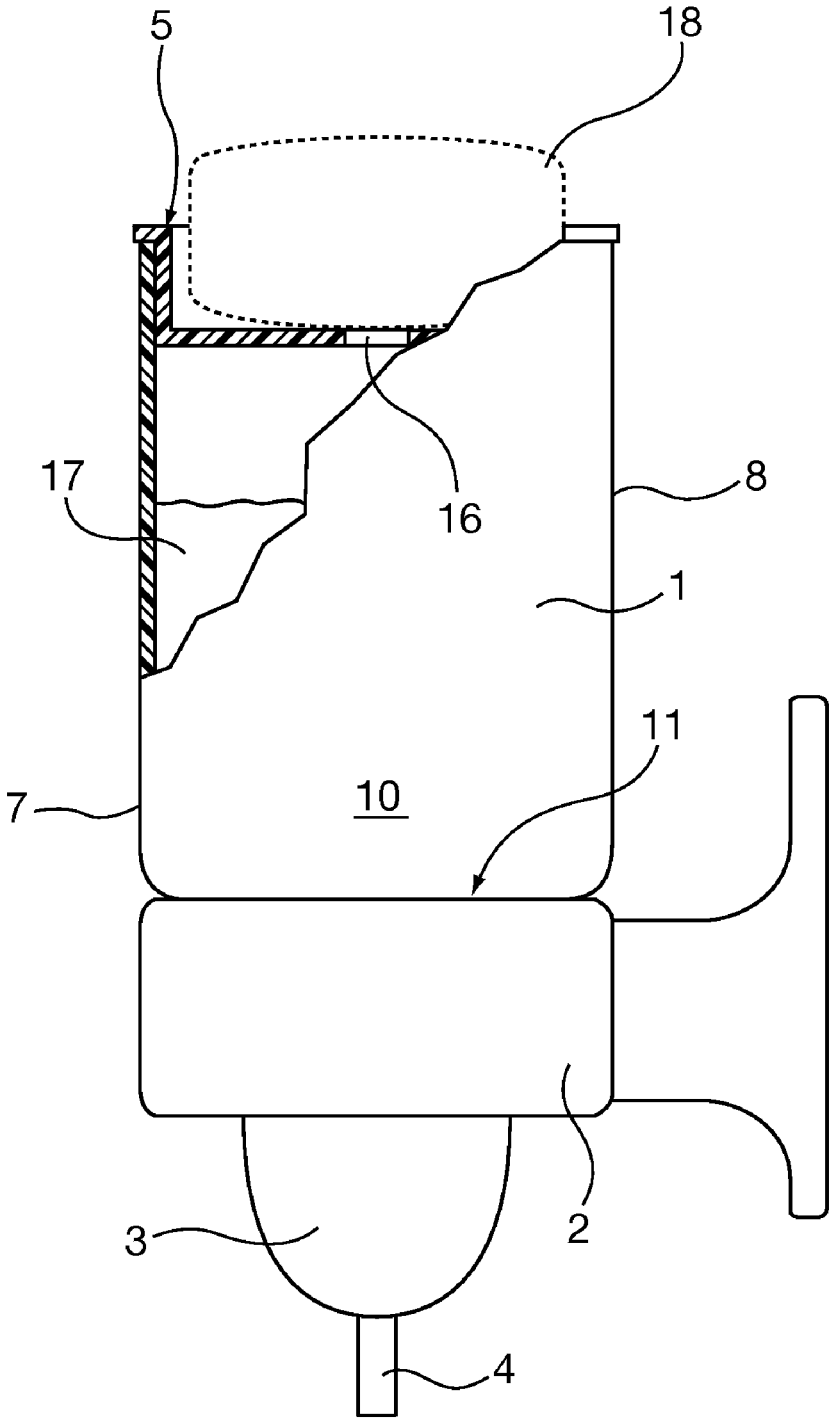
FIG. 2 is a side view of the bar soap recycler shown in FIG. 1, partially in section.

As shown in FIGS. 1 through 4, a first embodiment of the soap bar recycler comprises a reservoir 1, a mounting bracket 2 for supporting reservoir 1 and attaching it to a wall or the like, a valve housing 3 extending from the bottom of reservoir 1 and in liquid communication therewith, a dispensing valve 4 mounted in the lower portion of valve housing 3, and a soap dish 5 mounted at the top of reservoir 1.

Reservoir 1 is defined by a front wall 7, a back wall 8, side walls 9 and 10, and a bottom panel 11. Reservoir 1 is shown as being right rectangular in shape, but it can be of other shapes, such as cylindrical or stylistic designs. Reservoir 1 is open at the top. Valve housing 3 is mounted vertically oriented in bottom panel 11 of reservoir 1, and is in communication with the interior thereof. Valve housing 3 can be formed integrally with reservoir 1, or it can be a separate piece that is attached thereto by means such as screw threads. A dispensing valve 4 is installed within valve housing 3, and can be one of the commonly used valves such as a spring-biased piston which allows liquid to flow from reservoir 1 when pressed inwardly by a user. Alternatively, valve housing 3 can be oriented horizontally in the lower portion of front wall 7 or either of side walls 9 and 10.

Reservoir 1 is seated on mounting bracket 2, with valve housing 3 passing through bracket 2. Mounting bracket 2 can be secured to a wall or other vertical face by means of screws or the like, by gluing, or by an interlocking attachment device which can allow reservoir 1 to easily be removed. Reservoir 1 can be fixedly or releasably attached to mounting bracket 2.

The components of this invention may be made of any suitable material, such as plastic, metal, glass, or recycled material.

Figure 3:
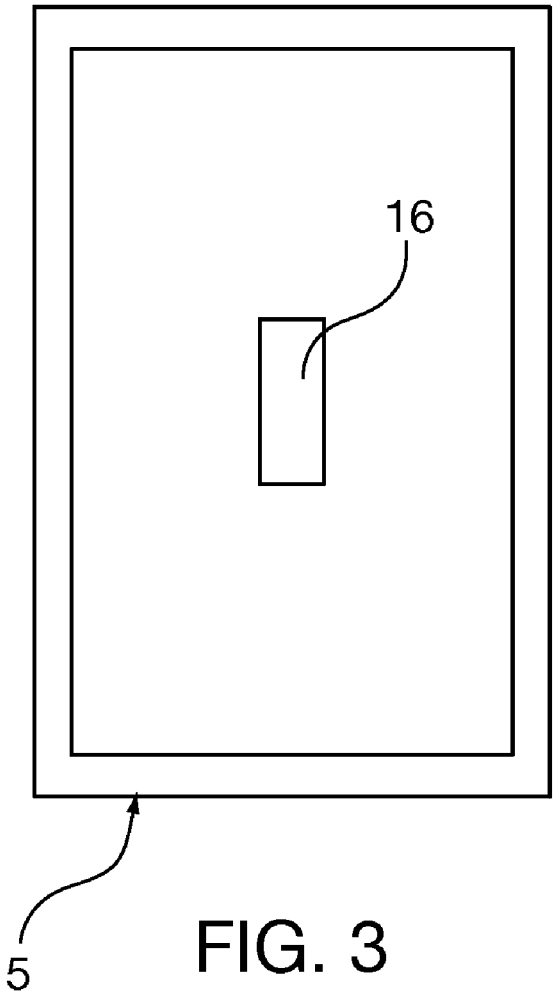
FIG. 3 is a top view of the soap dish mounted at the top of the soap bar recycler shown in FIG. 1.
Figure 4:
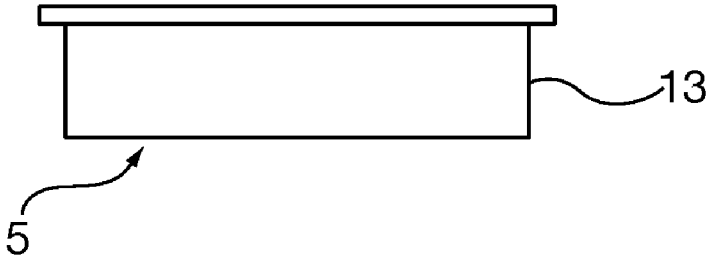
FIG. 4 is a side view of the soap dish mounted at the top of the soap bar recycler shown in FIG. 1.

Soap dish 5 is installed in the opening at the top of reservoir 1. As shown in FIGS. 3 and 4, soap dish 5 is of the same rectangular cross-sectional shape as reservoir 1, and it fits closely therein. Soap dish 5 is defined by four upstanding walls 13 and a bottom panel 14. An outwardly extending top peripheral flange 15 can be attached to walls 13 to support soap dish 5, or soap dish 5 can be mounted or attached by other conventional means, or can be press fit into reservoir 1. While soap dish 5 is shown here being removable, it alternatively can be formed integrally with reservoir 1. A single rectangular opening 16 is present in bottom panel 14, however, it is within the scope of the invention to provide multiple openings, and openings having other shapes.

In a first mode of operation, reservoir 1 initially is filled or partially filled with liquid soap 17, and the soap drippings, bits and slivers collected in soap dish 5 as a result of the use of a bar of soap 18 enter reservoir 1 through opening 16, there to mix with the liquid soap contained therein. Periodically, soap dish 7 can be flushed with water to cause any drippings, bits and slivers present therein to flow into reservoir 1. Bits and slivers of soap collected from other sources, as well as other liquids, also may be added to the liquid in the reservoir through opening 16 or directly by removing soap dish 7. In a second mode of operation, water is placed in reservoir 1, which will mix with soap drippings, bits and slivers entering reservoir 1 to form a liquid soap mixture. In both cases, the user has the option of utilizing the recycled liquid soap mixture, rather than a bar of soap in soap dish 5, by operating dispensing valve 4.

Figure 7:
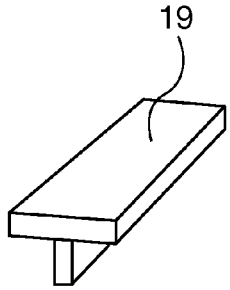
FIG. 7 is a perspective view of a closure plug that can be placed in the opening in the bottom the soap dish of the invention.

Another option for the use of the device is to close opening 16 by installing a closure plug 19 (FIG. 7) therein, in which case the recycling feature is disabled, and the reservoir can be used to dispense other solutions, such as hand lotion.

Figure 5:
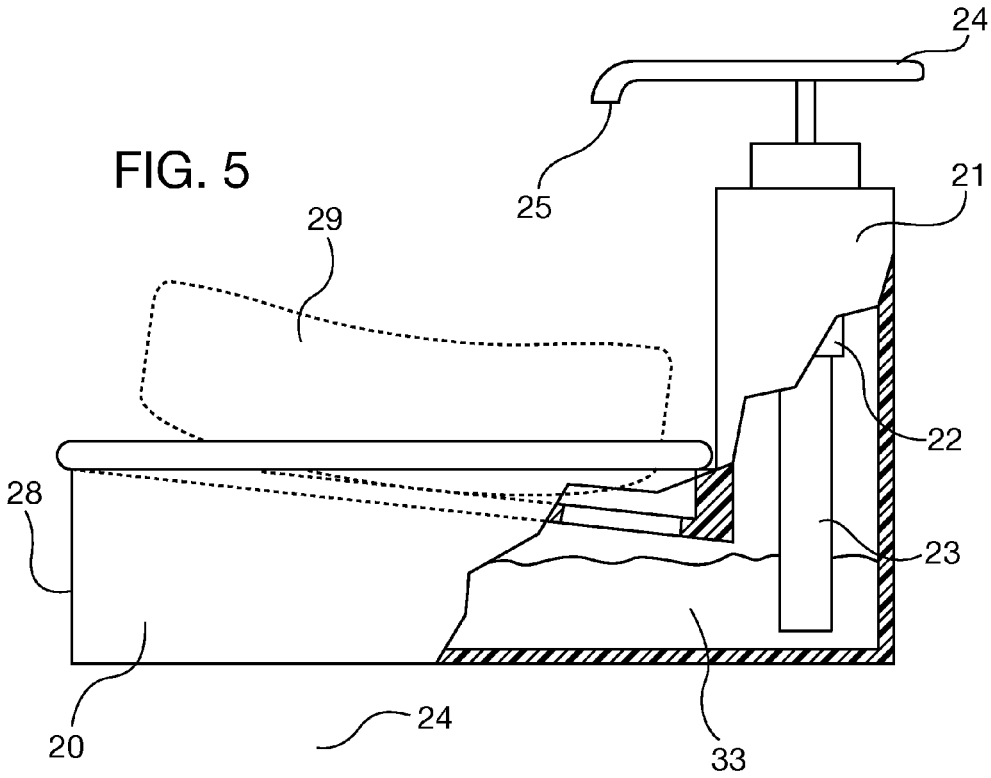
FIG. 5 is a side view of a second embodiment of the bar soap recycler of the invention, partially in section.
Figure 6:
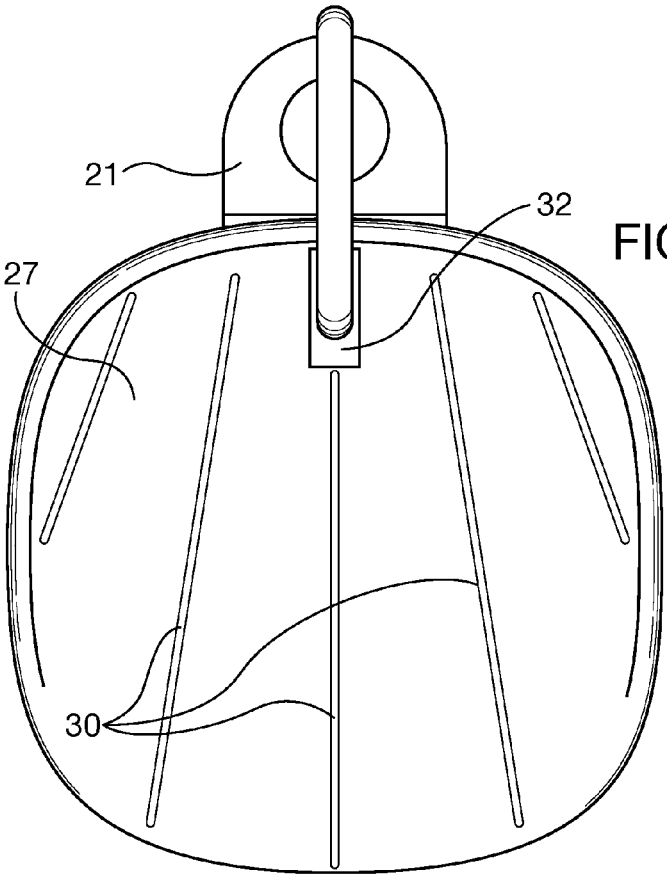
FIG. 6 is a top view of the bar soap recycler of the invention shown in FIG. 5, partially in section.

A second embodiment of the invention for use on a horizontal surface is shown in FIGS. 5 and 6. It has a generally circular upstanding curvilinear wall 28 defining a reservoir 20 with an open top. Integrally formed with reservoir 20 is a housing 21 containing a dispensing pump 22 having an intake pipe 23 and an operating handle 24 with a dispensing spout 25. Pump 22 can be of the type wherein pressing downwardly on operating handle 24 it to dispense a quantity of liquid from reservoir 20 through dispensing spout 25 onto the hand of the user.

A soap dish 27 is installed atop the wall 28 of reservoir 20 to receive a bar of soap 29. Soap dish 27 is shown as being decoratively configured in a scalloped pattern 30. As was the case with the first embodiment, soap dish 27 can be removable, as shown, or can be integral with reservoir 20. At least one opening 32 is provided in soap dish 27. It also is within the scope of the invention to utilize multiple openings, or other shapes of single or multiple openings. Again, the components of this embodiment of the invention may be of plastic and may be formed by conventional means such as molding, or other suitable materials and methods of manufacture.

Shapes and decorative designs other than those shown in the two embodiments described above are within the scope of the invention. For example, the entire device, or parts of the device, can be made in shapes which are especially appealing to children, such as an elephant or other animal or cartoon character. They also can be of any color or be transparent.

The operation of this embodiment of the invention is the same as that explained above with regard to the first embodiment, except for the fact that the liquid 33 in the reservoir is delivered by dispensing pump 22 to a point above soap dish 27. Also as is the case with the first embodiment, closure plug 19 can be installed in opening 32, which allows the reservoir to be utilized to dispense another fluid such as hand lotion.

While the present invention has been described in connection with what are considered practical and preferred embodiments, it is to be understood that it is not to be limited to the disclosed arrangements, but is intended to cover various arrangements which are included within the spirit and scope of the broadest possible interpretation of the appended claims so as to encompass all modifications and equivalent arrangements.

I claim:

1. A bar soap recycler comprising:

upstanding walls and a bottom panel attached together and defining a reservoir for containing a quantity of liquid, said reservoir having an open top;

a soap dish installed in said reservoir at said open top for receiving a bar of soap;

an opening in said soap dish communicating with said reservoir for permitting drippings, bits and slivers of soap and liquids to be introduced into said reservoir; and dispensing means for dispensing liquid from said reservoir;

whereby drippings, bits and slivers of soap and liquids can be collected and passed through said opening and combined in said reservoir to be recycled for use by operating said dispensing means.

2. The bar soap recycler of claim 1 wherein said dispensing means comprises a pump attached to said reservoir.

3. The bar soap recycler of claim 1 wherein said soap dish is removable from said reservoir.

4. The bar soap recycler of claim 1 wherein said soap dish is integral with said reservoir.

5. The bar soap recycler of claim 1 further comprising a closure plug receivable in said opening in said soap dish to selectively close said opening.

6. A bar soap recycler comprising:

an upstanding curvilinear side wall and a bottom panel attached together and defining a reservoir for containing a quantity of liquid, said reservoir having an open top;

a soap dish installed at said open top of said reservoir for receiving a bar of soap;

an opening in said soap dish communicating with said reservoir for permitting drippings, bits and slivers of soap and liquids to be introduced into said reservoir; and a dispensing pump mounted on said reservoir extending upwardly therefrom and in communication with said reservoir for dispensing liquid from said reservoir;

whereby drippings, bits and slivers of soap and liquids can be collected and combined in said reservoir to be recycled for use by operating said dispensing pump.

7. The bar soap recycler of claim 6 wherein said soap dish is removable from said reservoir.

8. The bar soap recycler of claim 6 wherein said soap dish is integral with said reservoir.

9. The bar soap recycler of claim 6 wherein said soap dish conforms in shape to said curvilinear walls of said reservoir.

10. The bar soap recycler of claim 6 further comprising a closure plug receivable in said opening in said soap dish to selectively close said opening.

11. The bar soap recycler of claim 6 wherein said soap dish has a decorative design.

* * * * *